United States Patent [19]

Keeven et al.

[11] Patent Number: 4,595,600

[45] Date of Patent: Jun. 17, 1986

[54] METAL CLADDING OF WIRE BY ATOMIZATION SPRAYING

[75] Inventors: James C. Keeven; Donald R. Felin; Henry J. Fisher, all of St. Louis, Mo.

[73] Assignee: FL Industries, Inc., Livingston, N.J.

[21] Appl. No.: 670,040

[22] Filed: Nov. 13, 1984

[51] Int. Cl.[4] ..... B21F 19/00; B05D 1/00; B05D 7/20

[52] U.S. Cl. ..... 427/5; 118/316; 118/325; 118/620; 427/46; 427/117; 427/319; 427/320; 427/321

[58] Field of Search ..... 427/5, 46, 117, 319, 427/320, 321; 118/620, 316, 325

[56] References Cited

U.S. PATENT DOCUMENTS 4,045,591 8/1977 Payne ..... 427/319 X

*Primary Examiner*—James R. Hoffman

*Attorney, Agent, or Firm*—Laff, Whitesel, Conte & Saret

[57] ABSTRACT

A method and apparatus for uniformly cladding a metal wire with a coating of a second metal is provided. The metal wire to be coated is preheated in a non-oxidizing atmosphere to a temperature slightly less than the melting point of the metal coating. The metal coating is present as a molten metal in an atomization chamber. A source of preheated, pressurized, non-oxidizing gas is utilized to inject such gas into spray nozzles. Each spray nozzle also receives molten metal that is drawn into and atomized in the nozzle. The molten metal is thusly sprayed onto the metal wire moving through the atomization chamber.

21 Claims, 2 Drawing Figures

METAL CLADDING OF WIRE BY ATOMIZATION SPRAYING

BACKGROUND OF THE INVENTION

The present invention relates to the continuous cladding of metal wire with a metal and, more particularly, to the atomization spraying of a uniform coating of metal onto a metal wire.

There are numerous known methods of cladding metal wire with a second metal. Throughout this application, the term metal wire will be used to mean both wire or thicker metal rod. Further, metal as used in reference to the atomization process of the present invention means pure elemental metals and various alloys thereof. The most widely known method of depositing a metal onto a metal wire is electroplating. Such process involves the steps of sizing and chemically cleaning the wire. A strike or thin metal interface of the coating metal is then deposited on the wire. For example, if the wire is steel and the coating metal is copper, a thin copper or nickel coating is deposited on the wire by an initial electroplating step to insure proper bonding of the copper coating to the wire. The final electroplating process is then accomplished wherein the copper coating of the desired thickness is deposited on the wire. There are several problems with such electroplating operations. Due to the electrochemical nature of the process, the wire to which the metal is applied must be extremely clean. The metal to be deposited is usually an elemental metal. Finally, the recent numerous governmental pollution control regulations on the electroplating industry require large investments in pollution control equipment to assure compliance.

Another method of depositing metal onto a wire involves the passing of the metal wire through a molten bath of the second coating metal. By controlling the speed of the wire, a desired amount of the second metal will adhere to the wire to form a clad metal wire. Problems with this method include the concentricity of the cladding metal on the wire and the adhesion of the cladding metal to the wire. Improper intial adhesion of the cladding metal to the wire is not a great problem where the wire is subsequently drawn down to a considerably lesser diameter whereby the adhesion of the cladding metal to the wire is improved by the combined pressure and temperature of the drawing process. But improper adhesion is a problem for clad wire where the final product is essentially the same diameter as the clad wire when exiting the process. (Only a final single die draw is necessary in such cases to smooth the outer surface when the initial adhesion is satisfactory).

In the manufacture of coated rod electrodes such as ground rods, the copper or stainless steel cladding of the steel rod is used for corrosion protection of the rod. Such rods are installed in the ground and are expected to have long service lives of many years. Accordingly, most applications require that such ground rods meet Underwriter's Laboratories (UL) specifications. These specifications require that the coating metal be applied to a thickness not less than a certain thickness (0.010 in. or 0.025 cm for certain metals) at any point on the rod. Accordingly it is desirable to have good control over the thickness of the coating metal. If the thickness of the coating metal varies, it must be applied in sufficient quantity to assure at least the minimum thickness at all locations on the rod. A final die drawing operation will not act to redistribute the coating metal to assure a uniform coating of a thickness to meet the specified requirements, but rather displaces a uniform amount of coating from all surfaces of the wire.

Another UL specification for such ground rods is that the coating metal must be sufficiently adhered to the rod such that no cracking of the coating occurs when the rod is bent through a certain angle (30° in certain applications). To meet such specifications, good degree of bonding between the coating and the rod is required.

Other specifications for various products, but the basic needs for the process of the present invention is a process that would insure the controlled depositing of a metal, including alloys, onto a metal wire to form a concentric coating of the desired thickness onto the wire. Further, a high degree of metallurgical bonding between the coating and the wire is desired. The process should be adaptable to a continuous coating operation. The process should require a minimum of one final die drawing or cold working of the coated rod. Ideally only a single die operation to size the final diameter and insure the physical properties of the wire would be required. The process should be adaptable to a wire having a patterned surface such as a reinforcing bar wherein no final die drawing would be possible.

Accordingly, it is an object of the present invention to provide an improved method and apparatus for the coating of a metal wire with a second metal.

SUMMARY OF THE INVENTION

The present invention provides a method and an apparatus for continuously coating a metal wire with a second metal by an atomization spraying process.

In the manufacture of products such as ground rods, it is desired to continuously coat a steel wire with copper, alloys of copper and zinc or pure zinc or a stainless steel and also to coat steel with aluminum or aluminum wire with copper. Numerous other combinations of metals can be applied and used in the method of the present invention. For example, coating metals can include aluminum, antimony, bismuth, cadmium, chromium, copper, cobalt, germanium, gold, indium, iron, lead, magnesium, manganese, nickel, niobium, palladium, platinum, silicon, silver, strontium, tellurium, tin, titanium, uranium, vanadium, zinc, or zirconium. For many products, there are industry standards as to the required thickness and tests for the quality of the bonding between the inner rod material, usually steel, and the coating material, usually copper. Such other products include reinforcing bars, down wires, bead wires for tires, welding wire and electrical lead wire.

Prior to coating the metal wire, it is usually straightened in a mechanical device. The continuously moving wire is then cleaned in a shot or grit blasting operation to remove any outer surface contamination such as mill scale.

The wire is then passed through a heating device wherein the wire is heated in a non-oxidizing atmosphere such as nitrogen to a temperature of just below the melting point of the metal with which the wire will be coated. The melting point of copper, for example, is 1981° F. (1083° C.). The wire could be heated to a temperature above the melting point of the coating metal and then cooled to a temperature slightly below the melting point of the coating metal when the coating metal is applied. Usually the heating is done by a high frequency induction heater in a chamber charged with nitrogen. This non-oxidizing atmosphere insures that the outer surface of the wire remains oxidation free when the metal coating is applied. The outer surface of the wire should be at a temperature below the melting point of the metal coating when the coating is applied.

It is desirable to utilize a high frequency induction heating operation so that only the outer surface of the wire is heated. The temperature is desired to penetrate only 20–50 mils (0.05–0.13 cm) into a 0.5 in (1.27 cm) diameter wire to assure that the strength of the wire is not significantly affected and the wire may be readily pulled over rollers and pulleys. The elevated surface temperature assures that the coating metal when applied will properly adhere to the wire due to the high energy content of the surface atoms of the wire and those of the molten spraying metal to assure good bonding between the metals. If the wire surface were at ambient temperature, the sprayed metal would solidify or freeze immediately upon hitting the wire surface and poor adhesion, in the manner of a cold solder joint, would result.

The metal wire, after being heated, enters the atomization chamber where it is sprayed with the coating of the outer or second metal. The wire enters the atomization chamber through an inlet sleeve usually comprised of a ceramic or refractory material selected to withstand the temperature of the preheated wire and of the molten metal. The heating device and the atomization chamber are both sealed to the atmosphere and under the same non-oxidizing, usually nitrogen, atmosphere. The base of the atomization chamber forms a crucible of which the inlet sleeve could be an integral part. The atomization chamber comprises a box-like or cylindrical structure of appropriate refactory material such as graphite of suitable thickness such that the coating metal is retained in molten form in the base of the chamber. The outside atmosphere is excluded from the chamber, and the chamber is continuously charged with a non-oxidizing gas such as nitrogen. The inlet sleeve is of such a height to preclude molten metal from running over its sides and possibly leaving the chamber through the inlet sleeve. The walls of the chamber are lined with a metal which is inert to the metal being sprayed such that metal oversprayed beyond the wire contacts this metal liner and falls or drops down into the molten metal in the base of the chamber for reuse. If the sprayed metal is copper, the liner is usually molybdenum. Further, to aid in the drops remaining liquid when contacting the walls, the walls themselves are kept at a temperature above the melting point of the second metal by such means as an external furnace in which the entire atomization chamber is kept. The molten metal entering the atomization chamber is controlled by a level sensor. This sensor controls the admission of molten metal when the level falls below a certain amount, but will not permit the addition of molten metal above the top of the inlet sleeve.

The atomization chamber further includes preferably four but possibly six or more nozzles for the atomization spraying of the molten metal onto the wire. If the metal being sprayed is copper, the preferred material for such nozzles is molybdenum or a molybdenum alloy. If a stainless steel is being sprayed, the preferred material for the nozzle is a ceramic. The design and material of the nozzle will depend on many factors such as the metal being sprayed, the thickness of metal to be deposited and the temperature of the molten metal. Each nozzle is supplied a pressurized, preheated, non-oxidizing gas such as nitrogen. The gas is preheated to near the melting point of the metal being sprayed. The nozzle spray opening also receives an input from the molten metal. The nozzle is designed such that, due to the Venturi effect, the molten metal is drawn upwardly into the pressurized gas stream, is atomized into appropriately sized droplets and is sprayed from the nozzle. The spray contacts the moving metal wire and, due to the temperature differential between the wire and molten metal droplets, is solidified on and bonded to the wire as a clad coating.

It will be understood that many variables affect the nozzle design, spray rate, droplet size, pressure of the spray gas and speed at which the wire is moved through the chamber. These variables include the compositions of the wire and the coating metal, the desired thickness of the coating and whether two or more atomization chambers are being used in tandem. Because of the nature of these variables, ultimate production rates for the desired values of the variables can only be established by actual operation and adjustment of the process.

The wire is usually moved along the center axis of the chamber, and the nozzles are mounted in or near the inside walls of the chamber. The nozzles are usually aligned in a plane normal to the wire and spray radially inwardly to assure an equal temperature wire section onto which the metal is being sprayed. This also helps in providing a uniform deposit of the metal and is saving of metal overspray that strikes the opposite lined walls of the chamber and runs back down into the molten metal in the bottom crucible of the chamber.

The coated wire exits the atomization chamber through an outlet sleeve similar to the inlet sleeve. The wire then may directly enter a forming die wherein the clad wire is drawn to a desired final diameter. Alternatively, the wire may be quenched by any suitable method such as oil or water spraying, and then be passed through a cold drawing die wherein the clad wire is drawn to a desired final diameter. The degree of required quenching will be limited due to the induction heating of only the surface of the wire instead of the entire wire. It may be, depending on many variables such as wire thickness and speed, that only atmosphere gas quenching is necessary. Due to the degree of control of the spraying process, the coated wire when entering the drawing die will be at or very slightly over the final desired diameter so that limited drawing effort and a very small reduction in diameter are required.

Most of the parameters such as wire velocity, nozzle pressure and spray rate are subject to change based on the number and design of the nozzles, the types of wire and coating metal and the temperatures of the wire and the composition of the sprayed coating metal. The coating thickness is normally from 0.002 to 0.1 inches (0.05 to 0.25 cm) from a single spraying operation, but can be increased by using two or more spraying chambers in tandem. Further, although the preferred embodiment will show a wire passing upwardly through the atomization chamber, the process may be designed to have the wire pass downwardly through the chamber.

In certain circumstances, it may be desirable to heat the wire in an inert atmosphere such as pure argon and to spray the molten metal using an inert gas such as pure argon. However, cost considerations would usually result in utilizing nitrogen as the heating atmosphere and spraying medium.

In particular, the present invention provides a method of cladding a metal wire with a second metal comprising the steps of providing a metal wire and preheating said wire in a non-oxidizing atmosphere, spraying said preheated wire with a second metal that has been atomized in a non-oxidizing gas, and controlling the rate at which the wire passes through spray of the second metal, the rate of the spray and the temperature differential between the wire and the spray of the second metal such that the second metal is deposited on and bonded to the outer surface of the wire.

The present invention also provides an apparatus for cladding metal wire comprising an atomization chamber having an inlet opening adapted to receive a preheated metal wire and an outlet adapted to pass a clad metal wire, said atomization chamber including inlet means to permit entry of a molten metal and storage means to store said molten metal, said atomization chamber also including a gas source and nozzles to which said gas source is connected, and an inlet from said molten metal storage means to said nozzles whereby said molten metal is atomized at said nozzles by said gas and is sprayed onto said metal wire moving through said atomization chamber thereby forming a clad metal coating on said metal wire.

DESCRIPTION OF THE PREFERRED EMBODIMENT

Figure 1:
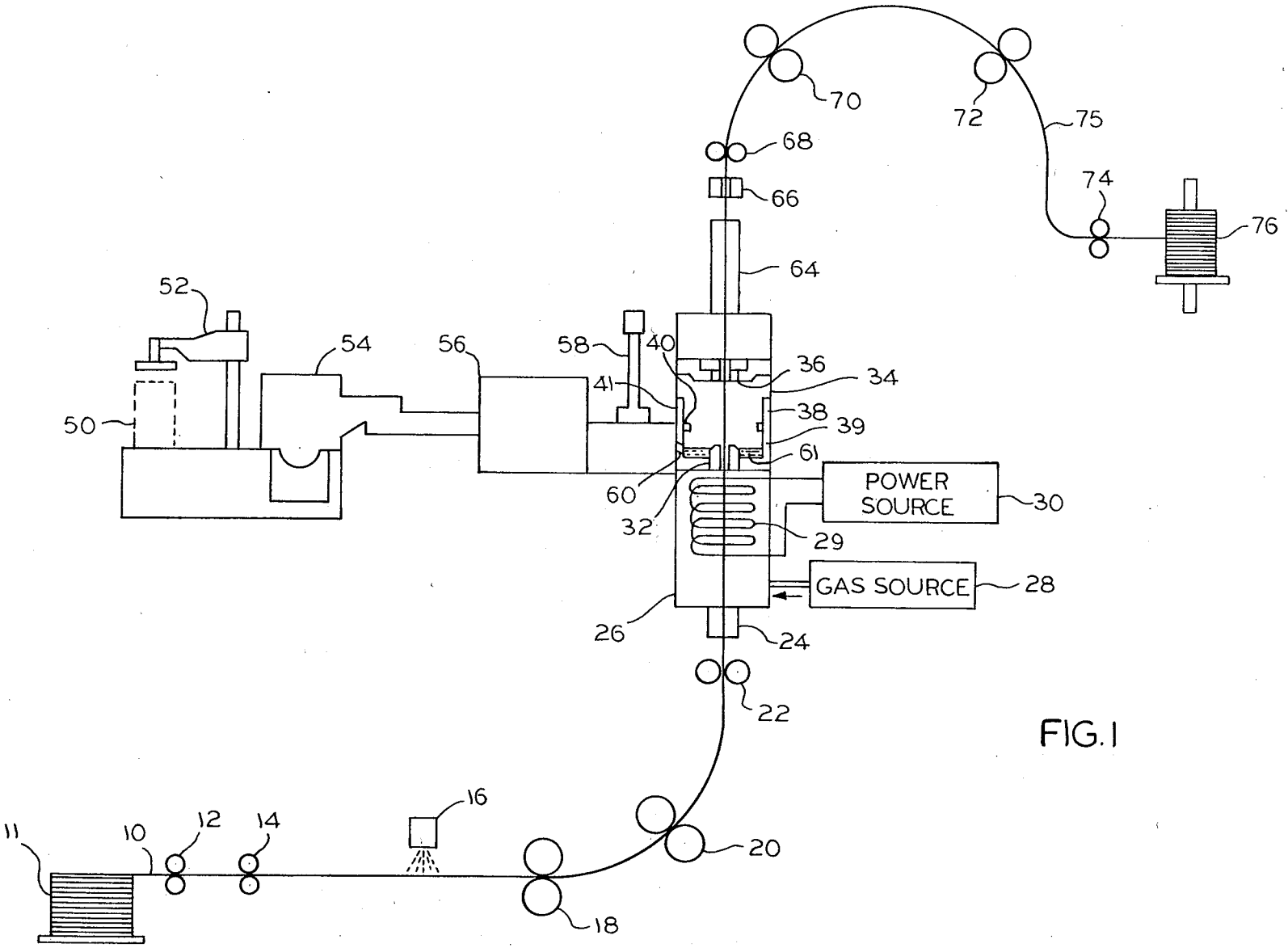
FIG. 1 is a schematic diagram of the various elements utilized in the process of the present invention.

Referring now to FIG. 1 of the drawings, a schematic diagram of the wire cladding process of the present invention is shown.

The metal wire 10 to be coated exits a reel 11 and enters a straightener comprising roller pairs 12 and 14. These rollers are adjustable to deliver the desired amount of tensioning to wire 10 depending on the thickness and material of wire 10. A cleaning station 16 comprises a grit blasting operation to remove any oxidation or mill scale from the outer surface of wire 10.

The metal wire then passes through guide roller pairs 18, 20 and 22 before passing through seal 24 to enter wire preheater 26. Of course the number of such roller pairs depends on the physical layout of the process stations. Seal 24 usually comprises a metal sleeve, with the metal usually a high alloy steel or stainless steel. The sleeve is easily replaceable to accommodate different diameter wires with a simple sleeve change. A source 28 of a non-oxidizing atmosphere such as nitrogen gas is connected to preheater 26. By the action of sleeve 24, preheater 26 is effectively sealed from the atmosphere, and accordingly wire 10 is heated in a non-oxidizing atmosphere. The heating is usually accomplished by a high frequency induction coil 29 which is connected to a power source 30.

The metal used to coat the wire 10 is stored at 50. Typically, wire 10 is steel and the coating metal is copper, a copper base alloy or zinc. The coating metal is moved in selected quantities by charging mechanism 52 into melting furnace 54. Usually melting furnace 54 is an electrically heated furnace to assure purity of the coating metal. The molten metal flows from melting furnace 54 to holding furnace 56. A metal level sensor 58 allows the necessary amount of the molten metal 61 to flow into the crucible bottom of atomization chamber 34 over inlet 60.

Figure 2:
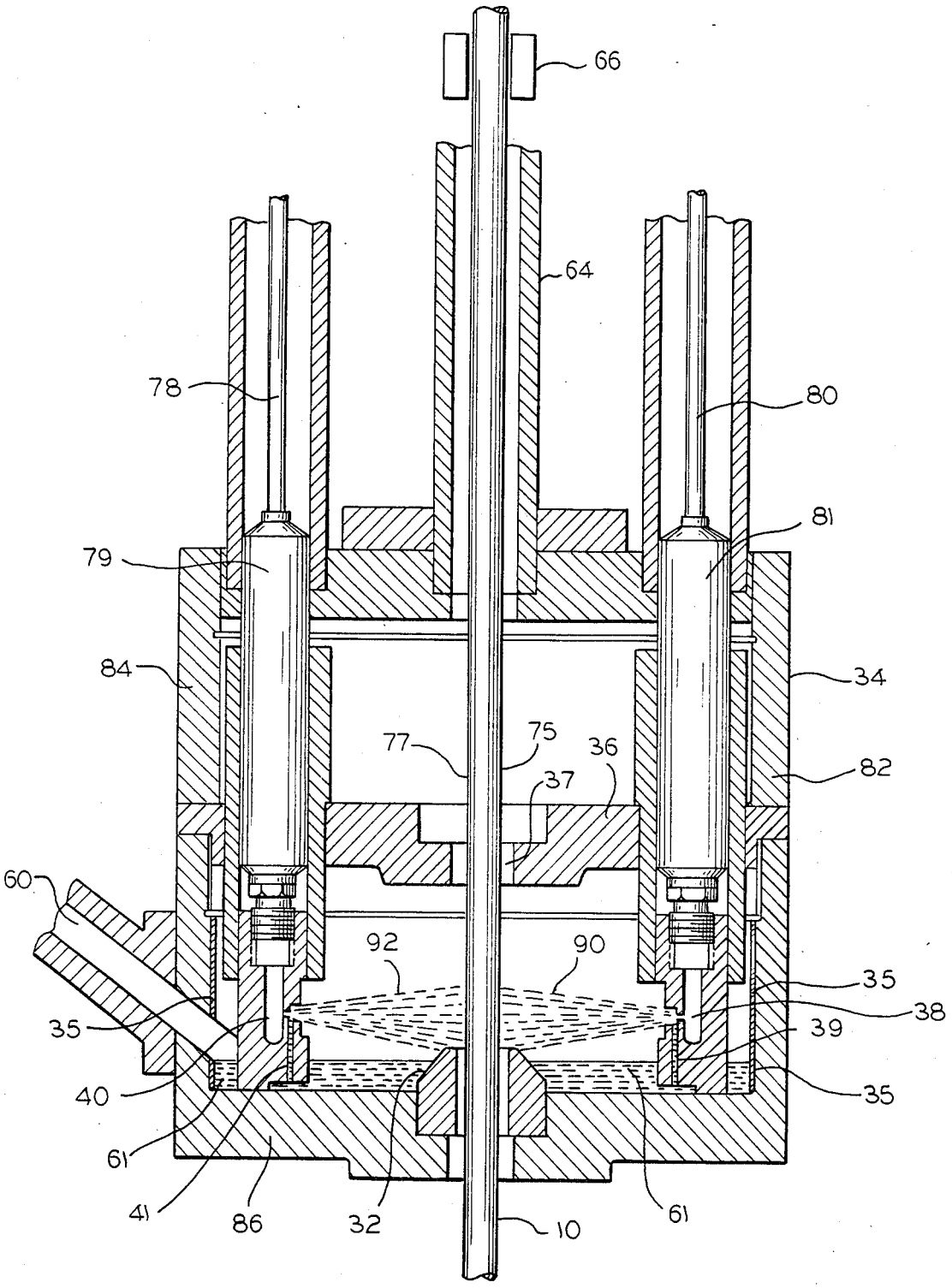
FIG. 2 is a partial cross-section of the atomization chamber of the present invention.

Referring now also to FIG. 2 for a more detailed view of atomization chamber 34, it is seen that chamber 34 is comprised of walls 82, 84 and bottom 86, all usually made of graphite or a suitable refractory material to form a crucible to receive and hold molten metal 61 therein. The walls of the spray chamber are lined with a metal 35 impervious to the metal being sprayed to assure the downflow of the overspray back into the molten metal 61 in the crucible bottom 86. Inlet sleeve 32 of bottom 86 is raised to assure that the molten metal does not flow out of the chamber. To assure that the overspray drops flow back into the crucible bottom 86, it is desirable to have the entire atomization chamber or at least the walls 82, 84 and bottom 86 externally heated to a temperature above the melting point of the metal being sprayed. Chamber 34 has a cover 36 usually of graphite and having an opening of appropriate diameter to permit wire 77 clad with coating 75 to exit therefrom.

Spray nozzle 40 is located on one inside wall of chamber 34 and nozzle 38 is located on an opposite inside wall of chamber 34. As mentioned above, such chambers would preferably include four, six or eight such nozzles, but two are shown here for simplifying the explanation. Spray nozzle 40 has an inlet 41 from the crucible bottom 86 of chamber 34 and spray nozzle 38 has an inlet 39 from the crucible bottom 86 of chamber 34. Both inlets 39 and 41 provide molten metal 61 upwardly to nozzles 38 and 40 by the Venturi effect of the pressurized gas being sprayed therethrough. Nozzle 40 receives pressurized gas through an inlet 78 and gas preheating chamber 79, and nozzle 38 receives pressurized gas through an inlet 80 and preheating chamber 81. The gas is heated to near the melting point of the metal being sprayed. Usually such inlets 78, 80 extend upwardly from nozzles 40, 38 and comprise piping or tubing. The pressurized gas is a non-oxidizing gas such as nitrogen.

When the metal being sprayed is copper or a copper alloy, nozzles 38 and 40 each are usually comprised of molybdenum or a molybdenum alloy. If the metal being sprayed were stainless steel, the nozzle would be a ceramic material. The nozzle must be chosen of a material relatively inert to the metal being sprayed, and of sufficient wear characteristics. Each nozzle 38, 40 is of an elongated shape cut out in the block in which it is formed, having an inlet at the top for the pressurized gas, an outlet at the side for each spray 90, 92 to exit and an inlet 39, 41 off the bottom of the spray inlet to receive the molten metal 61. The spray inlet is designed such that a Venturi effect is created, and the molten metal 61 is drawn upwardly and atomized by the gas spray and the nozzle design. The sprays 90, 92 deposit the metal coating 75 onto wire 10.

When clad wire 77 exits atomization chamber 34 through cover 36, it passes through water spray cooling tower 64. Coating 75 is bonded and solidified onto wire 10 upon striking wire 10 in chamber 34 due to the selected temperature difference between the surface of preheated wire 10 and molten metal sprays 90, 92, the amounts of molten metal 61 in the sprays and the speed at which wire 10 is moving through chamber 34.

Upon leaving cooling tower 64, clad wire 77 enters a die 66 wherein clad wire 77 is drawn to a desired diameter. It should be understood that die 66 which clad wire 77 enters after exiting cooling tower 64 may alone be sufficient to accomplish the desired final sizing and physical working of clad wire 77.

Clad wire 77 then enters final pairs of guide rollers 68, 70, 72 and 74 and is coiled onto roll 76. Clad wire 77 is now complete and may be shipped as is or further processed on site to form ground rods or other desired products.

What is claimed is:

1. A method of cladding a metal wire with a second metal comprising the steps of:

providing a metal wire and preheating said wire in a non-oxidizing atmosphere;

spraying said preheated wire with a second metal that has been atomized in a non-oxidizing gas, and controlling the rate at which the wire passes through the spray of the second metal, the rate of the spray and the temperature defferential between the wire and the spray of the second metal such that the second metal is deposited on and bonded to the outer surface of the wire.

2. The method of claim 1, wherein the temperature to which the wire is preheated is slightly below the melting point of the second metal.

3. The method of claim 1, wherein the second metal is deposited to a uniform, preselected thickness on said wire.

4. The method of claim 1, wherein the wire is preheated in a high frequency induction heater that heats only the surface of the wire to a preselected depth.

5. The method of claim 1, wherein the non-oxidizing atmosphere in which the metal wire is preheated comprises essentially nitrogen.

6. The method of claim 1, wherein the gas used to spray the atomized second metal comprises nitrogen preheated to a temperature near that of the melting point of the second metal.

7. The method of claim 1, wherein the metal wire passes through an atomization chamber;

said second metal being present in said atomization chamber in a molten state;

said gas being passed through a nozzle which also accepts a flow of said second metal thereby atomizing said second metal for spraying onto said metal wire.

8. The method of claim 7, wherein said second metal is added in molten form to a reservoir in said atomization chamber on a controlled basis by the action of a liquid level sensor.

9. The method of claim 1, wherein the second metal is capable of being melted and atomized by spraying and comprises one or more of the following metals:

aluminum, antimony, bismuth, cadmium, chromium, copper, cobalt, germanium, gold, indium, iron, lead, magnesium, manganese, nickel, niobium, palladium, platinum, silicon, silver, strontium, tellurium, tin, titanium, uranium, vanadium, zinc, or zirconium.

10. Apparatus for cladding metal wire comprising:

at atomization chamber having an inlet opening adapted to receive a preheated metal wire and an outlet adapted to pass a clad metal wire;

said atomization chamber including inlet means to permit entry of a molten metal and storage means to store said molten metal;

said atomization chamber also including a gas source and a nozzle to which said gas source is connected, and an inlet from said molten metal storage means to said nozzle;

whereby said molten metal is atomized at said nozzle by said gas and is sprayed onto said metal wire moving through said atomization chamber thereby forming a clad metal coating on said metal wire.

11. The apparatus of claim 10, wherein said gas source supplies a preheated, non-oxidizing gas under pressure to said nozzle, and said nozzle is so arranged such that said molten metal is drawn upwardly by the decreased pressure of the gas stream through said nozzle.

12. The apparatus of claim 10, further including a heating chamber for the induction heating of the metal wire to a preselected depth from its surface in a non-oxidizing atmosphere prior to entering the atomization chamber.

13. The apparatus of claim 10, wherein said atomization chamber includes at least two gas sources and at least two nozzles to provide a uniform coating of said molten metal on said metal wire.

14. The apparatus of claim 10, wherein said molten metal storage means comprises a crucible forming the walls and bottom section of said atomization chamber, and said walls and bottom section of said crucible are heated to a temperature near the melting point of the molten metal.

15. The apparatus of claim 10, wherein the amount of said molten metal drawn into said nozzle is controlled by an adjustment to said nozzle.

16. A method of coating a metal wire with a uniform coating of a metal composition comprising the steps of:

providing a metal wire and heating said wire in non-oxidizing atmosphere to a temperature slightly below the melting point of the metal composition to be coated onto the wire;

passing said heated wire into an atomization chamber, spraying said wire with an atomized mixture of the molten metal composition and a non-oxidizing pressurized gas, said spraying being arranged such that a uniform coating of the metal composition is deposited on said wire.

17. The method of claim 16, wherein the coated wire is drawn through a die to control the final diameter of the coated wire.

18. The method of claim 16, wherein the temperature differential between the molten metal composition and the heated wire, the rate at which the wire moves through the atomization chamber and the amount of molten metal composition released through the spray nozzles in a specified time period are all controlled to control the thickness of the coating of the metal composition in the wire.

19. The method of claim 16, wherein the metal wire is an iron base alloy, and the metal composition to be coated onto the wire comprises one or more of the following metals: aluminum, cadmium, chromium, cobalt, copper, gold, lead, magnesium, manganese, nickel, palladium, platinum, silicon, silver, tin, titanium, uranium, vanadium, zinc or zirconium.

20. The method of claim 16, wherein the wire is an iron base metal and the metal composition to be coated onto the wire is an iron base stainless steel including at least 10% chromium and up to 8% nickel.

21. The method of claim 16, wherein said wire is heated by induction heating to a preselected depth from its surface.

* * * * *

UNITED STATES PATENT AND TRADEMARK OFFICE

CERTIFICATE OF CORRECTION

PATENT NO. : 4,595,600

DATED : June 17, 1986

INVENTOR(S) : JAMES C. KEEVEN; DONALD R. FELIN; HENRY J. FISHER

It is certified that error appears in the above—identified patent and that said Letters Patent is hereby corrected as shown below:

Col. 7, Line 61, change "at" to --an--.

Signed and Sealed this

*Sixteenth* Day of *September 1986*

[SEAL]

*Attest:*

DONALD J. QUIGG

*Attesting Officer*

*Commissioner of Patents and Trademarks*